US007567209B2

(12) United States Patent
Tanaka et al.

(10) Patent No.: US 7,567,209 B2
(45) Date of Patent: Jul. 28, 2009

(54) MICROSTRIP ANTENNA AND CLOTHES ATTACHED WITH THE SAME

(75) Inventors: Masato Tanaka, Tokyo (JP); Jae-Hyeuk Jang, Tokyo (JP)

(73) Assignee: National Institute of Information and Communications Technology, Incorporated Administrative Agency, Tokyo (JP)

( * ) Notice: Subject to any disclaimer, the term of this patent is extended or adjusted under 35 U.S.C. 154(b) by 157 days.

(21) Appl. No.: 10/577,238

(22) PCT Filed: Oct. 27, 2003

(86) PCT No.: PCT/JP03/13763

§ 371 (c)(1),
(2), (4) Date: Dec. 22, 2006

(87) PCT Pub. No.: WO2005/041356

PCT Pub. Date: May 6, 2005

(65) Prior Publication Data

US 2007/0210973 A1 Sep. 13, 2007

(51) Int. Cl.
*H01Q 1/38* (2006.01)

(52) U.S. Cl. ..... 343/700 MS

(58) Field of Classification Search ..... 343/700 MS, 343/702, 720

See application file for complete search history.

(56) References Cited

U.S. PATENT DOCUMENTS

| | | | | |
|---|---|---|---|---|
| 6,466,169 | B1 * | 10/2002 | Harrell et al. | 343/700 MS |
| 7,015,862 | B2 * | 3/2006 | Takei et al. | 343/700 MS |
| 7,286,098 | B2 * | 10/2007 | Ogino et al. | 343/833 |
| 2005/0052334 | A1 * | 3/2005 | Ogino et al. | 343/866 |
| 2005/0099337 | A1 * | 5/2005 | Takei et al. | 343/700 MS |
| 2006/0109178 | A1 * | 5/2006 | Takeuchi et al. | 343/700 MS |

FOREIGN PATENT DOCUMENTS

| | | | |
|---|---|---|---|
| EP | 1314548 | A1 | 5/2003 |
| JP | 5-18111 | U | 3/1993 |
| JP | 6-283885 | A | 10/1994 |
| JP | 8-242108 | A | 9/1996 |
| JP | 11-188014 | A | 7/1999 |

(Continued)

OTHER PUBLICATIONS

Mobile Phone Fabric Antennas Intergrated within clothing, 11th International Conference on Antennas and Propagation, Apr. 17-20, 2001, Conference Publication No. 480.

*Primary Examiner*—Huedung Mancuso
(74) *Attorney, Agent, or Firm*—Birch, Stewart, Kolasch & Birch, LLP

(57) ABSTRACT

In a microstrip antenna equipped with a nearly flat plate-like radiating conductor, a nearly flat plate-like ground conductor having larger area than the radiating conductor, and a dielectric substrate set between the radiating conductor and the ground conductor, and one terminal of a feeding cable is connected to the radiating conductor, and the other terminal is connected to the ground conductor, the radiating conductor and the ground conductor are composed of nearly cloth-like substances having flexibility and conductivity, and also the dielectric substrate is composed of a nearly cloth-like substance having flexibility and insulation property, and the connection of the terminal of the feeding cable to the radiating conductor or the ground conductor is composed of by soldering through a conductive medium.

7 Claims, 1 Drawing Sheet

FOREIGN PATENT DOCUMENTS

| | | | |
|---|---|---|---|
| JP | 2001-210986 | A | 8/2001 |
| JP | 2001-217587 | A | 8/2001 |
| JP | 2002-164727 | A | 6/2002 |
| JP | 2003-209422 | A | 7/2003 |
| JP | 2003-258539 | A | 9/2003 |
| JP | 2003-264416 | A | 9/2003 |
| WO | WO-01/39326 | A1 | 5/2001 |
| WO | WO-02/056416 | A1 | 7/2002 |
| WO | WO-02/056425 | A1 | 7/2002 |

* cited by examiner

MICROSTRIP ANTENNA AND CLOTHES ATTACHED WITH THE SAME

TECHNICAL FIELD

The present invention relates to a microstrip antenna having flexibility to be attachable on clothes, and clothes attached with the antenna.

BACKGROUND ART

A microstrip antenna is used as an antenna for a mobile station such as an automobile, or an antenna for a cellular phone and an antenna for satellite communication.

A dielectric substrate or a feeding circuit substrate of a conventional microstrip antenna was hard and heavy one. In addition, a radiating conductor or a ground conductor was also stiff, and the whole assembly was a hard and heavy one.

On the contrary, the present applicants have disclosed, in Japanese application No. 2002-60010, a technology for attaching a microstrip antenna to clothes or a hat and the like, by composing a dielectric substrate, a radiating conductor or a ground conductor by flexible material.

When a conventional microstrip antenna was fed by a pin using a coaxial connector, an inner conductor of the coaxial connector was enough to be directly soldered to a radiating conductor of the microstrip antenna formed with metal foil such as copper foil, while not to contact with a ground conductor of the microstrip antenna formed with metal foil such as copper foil, and also an outer conductor of the coaxial connector to be directly soldered to the ground conductor.

However, to furnish flexibility to a microstrip antenna, conductive cloth is used as a radiating conductor and a ground conductor. In the case when a cloth woven by a polyester fiber which coated with copper and covered with a surface nickel layer on the copper coating and the like are used as a conductive cloth, there was a problem such as insufficient soldering on to the surface nickel layer, or being not suitable to soldering because heat resistant temperature of polyester is 120° C.

Under these circumstances, it is an object of the present invention to provide a microstrip antenna which can be used onto cloth, due to being light weight, flexible and without generating wrinkles, and be produced by soldering handily during the production process, and clothes attached with the same.

DISCLOSURE OF INVENTION

A microstrip antenna of the present invention and clothes attached with the same have the following composition to solve the above-described problems.

Namely, the microstrip antenna of the present invention is equipped with a nearly flat plate-like radiating conductor, a nearly flat plate-like ground conductor having larger area than the radiating conductor, and a dielectric substrate set between the radiating conductor and the ground conductor, wherein one terminal of a feeding cable is connected to the radiating conductor, and the other terminal is connected to the ground conductor, the radiating conductor and the ground conductor are characterized by being composed of nearly cloth-like substances having flexibility and conductivity, and also the dielectric substrate is composed of a nearly cloth-like substance having flexibility and insulation property, and the connection of the terminal of the feeding cable to the radiating conductor or the ground conductor is composed of by soldering through a conductive medium.

Hereat, the conductive medium may be composed of a metallic plate-like substance adhered with conductive adhesives at a surface opposing to the radiating conductor or the ground conductor.

In particular, when the metallic plate-like substance is made of copper as a main component, soldering can suitably be functioned.

The terminal of the feeding cable connected to the radiating conductor may be composed a core wire which is an inner conductor of the feeding connector, and also the terminal of the feeding cable connected to the ground conductor may be composed an outer conductor of the feeding connector, and the core wire may pass through a pore part set in the ground conductor, and may be connected to the radiating conductor without contacted with the ground conductor.

The radiating conductor or the ground conductor may be a cloth woven or compressed by symthtic reisn fiber such as a polyester fiber or an aramid fiber, which fiber is coated with copper and covered with a surface nickel layer on the copper coating, and the dielectric substrate may be made of felt or clothing fabric.

Clothes attached with a microstrip antenna may be formed by attaching such a microstrip antenna at the exterior surface of the clothes.

Figure 1:
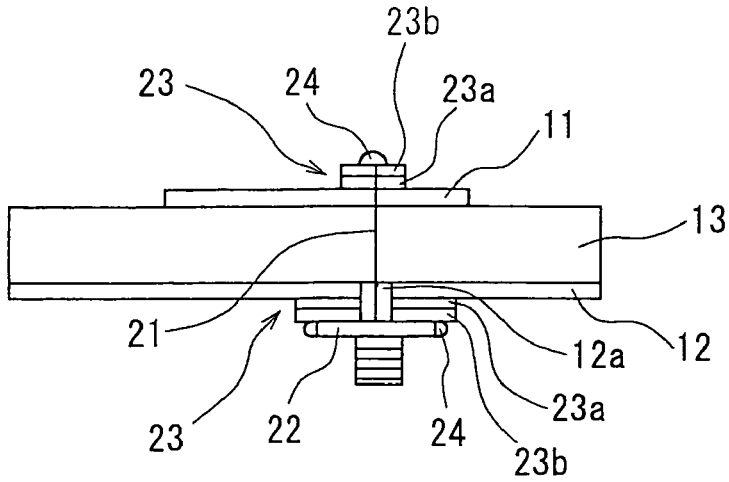
FIG. 1 is a cross-sectional front elevation view of a microstrip antenna.

Reference numerals represent each as follows; 11: radiating conductor, 12: ground conductor, 12*a:* pore part, 13: dielectric substrate, 21: core wire, 22: outer conductor, 23: conductive medium, 23*a:* conductive adhesives, 23*b:* metallic plate-like substance, and 24: solder.

BEST MODE FOR CARRYING OUT THE INVENTION

Embodiments of the present invention are explained below based on drawings.

Shape of a radiating conductor was expressed as thin disk-like shape, and shapes of a ground conductor and a dielectric substrate as thin square flat plate-like shape here, as one example. However, these shapes are arbitrary and various polygon or closed surfaces can be utilized, as appropriate.

In addition, this Example is based on a pin feeding system, however, a feeding system using a microstrip line or a feeding system by electromagnetic coupling can be used, as appropriate.

Such change in designing items is disclosed, for example, in "Satellite Communication" (Naoshi Iida, Ohmsha Ltd., 1997) and the like. The present invention can utilize, as appropriate, items disclosed in such conventional references.

Figure 2:
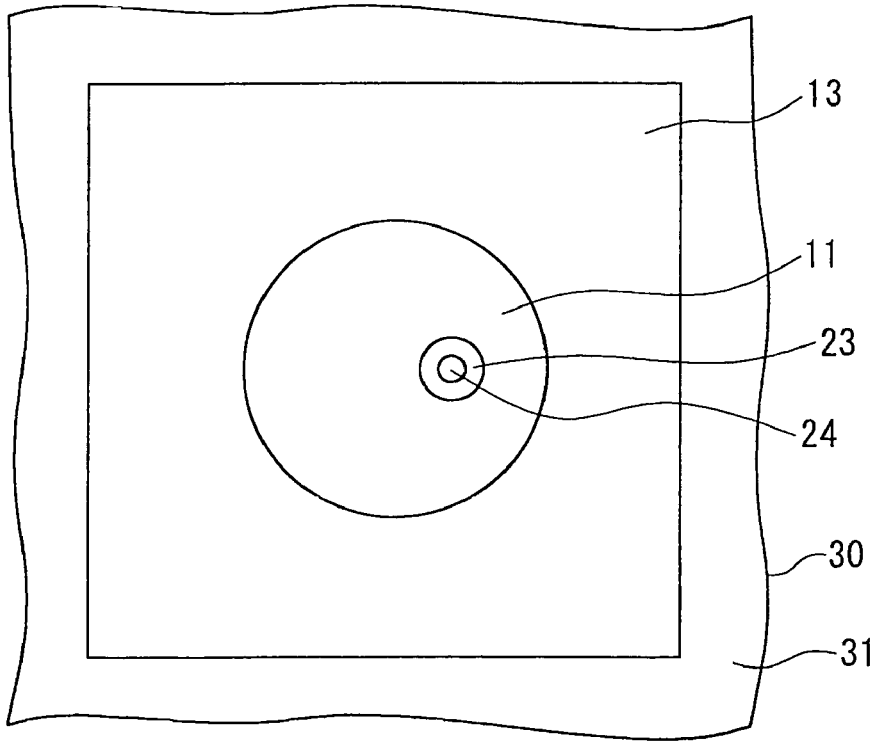
FIG. 2 is a plan view of a microstrip antenna in usage pattern.

A cross-sectional front elevation view and a plan view of a microstrip antenna are shown in FIG. 1 and FIG. 2, respectively.

A microstrip antenna is equipped with a nearly flat plate-like radiating conductor (11), a nearly flat plate-like ground conductor (12) having larger area than the radiating conductor (11), and a dielectric substrate (13) set between the radiating conductor (11) and the ground conductor (12), and the fundamental composition is that one terminal (21) of a feeding cable is connected to the radiating conductor (11), and the other terminal (22) is connected to the ground conductor (12).

In the present invention, as is described in detail later, a microstrip antenna can be used onto clothes (30), due to being light weight, and flexible and without generating wrinkles, by using nearly cloth-like substances having flexibility and conductivity as the radiating conductor (11) and the ground conductor (12), and also by using a nearly cloth-like substance having flexibility and insulation property as the dielectric substrate (13).

In FIG. 2, the lower surface of a ground conductor (12) is adhered to the exterior surface (31) of clothes (30).

Copper being relatively cheap and having low electric resistance is usually used as a radiating conductor (11) and a ground conductor (12), however, in the present invention, a conductive cloth-like substance is used.

As a conductive cloth, it is made possible to use a cloth woven or compressed by symthtic reisn fiber such as a polyester fiber or an aramid fiber and the like, which fiber is coated with copper and covered with a surface nickel layer on the copper coating can be utilized.

In addition, a cloth-like substance formed by a conductive fiber can also be utilized.

A conductive fiber includes, for example, such one as obtained by melt-conjugate-spinning of two components of a conductive layer compounded, in high concentration, with conductive fine particles such as carbon black or a metallic compound, and a usual polymer layer to protect the conductive layer and the like.

As a dielectric substrate (13), a cloth-like substance having flexibility and insulating property, such as clothing fabric including felt or cloth or blanket and the like is used.

Larger relative dielectric constant of a dielectric substrate (13) shortens radiowave wavelength inside the dielectric, and contributes to compact sizing of an antenna.

On the other hand, low relative dielectric constant and a thicker dielectric substrate (13) are preferable to broaden bandwidth of a microstrip antenna.

Here, in the present invention, the connection of the terminals (21) (22) of the feeding cable to the radiating conductor (11) or the ground conductor (12) is carried out by solder (24) through the conductive medium (23).

In an Example illustrated, the terminal of the feeding cable connected to the radiating conductor (11) is a core wire (21) which is the inner conductor of the feeding connector, and the terminal of the feeding cable connected to the ground conductor (12) is the outer conductor (22) of the feeding connector. The core wire (21) passes through a pore part (12*a*) set in the ground conductor (12), which part is provided there so as to have a little larger diameter than the core wire (21), and connected to the radiating conductor (11) without contacted with the ground conductor (12).

In this connection, the core wire (21) may be contacted with or separated from the dielectric substrate (13). To be separated, a hole may be set to the dielectric substrate (13) similarly as the pore part (12*a*), and a cylinder and the like may be set, as appropriate.

In the case when a conductive cloth woven or compressed by a polyester fiber which is coated with copper and covered with a surface nickel layer on the copper coating is used as the radiating conductor (11) or the ground conductor (12), to furnish flexibility to a microstrip antenna, soldering was conventionally difficult.

Therefore, in the present invention, the solder (24) is made through the conductive medium (23) composed of the metallic plate-like substance (23) adhered with conductive adhesives (23*a*) at a surface opposing to the radiating conductor (11) or the ground conductor (12). As material for the metallic plate-like substance (23*b*), copper is preferable and as an embodiment thereof, a sheet-like substance such as a thin film or a tape can be utilized, as appropriate, as well as a thin plate having certain thickness and strength.

By using the conductive medium (23), soldering can be carried out easily and in a short time. In addition, thermal degradation of conductive cloth such as a polyester can be suppressed, because it does not directly contacted with a high temperature solder iron or the solder (24).

The conductive medium (23) may be a conductive tape integrated combination of the conductive adhesives (23*a*) such as an acrylic-based conductive adhesive and the metallic plate-like substance (23*b*) such as copper foil and the like.

EXAMPLE

An antenna having structure shown in FIG. 1 was produced for experiment to confirm operability of a microstrip antenna of the present invention.

As the radiating conductor (11), conductive cloth having circular shape with a diameter of 60 mm, a thickness of 0.15 mm, a surface density of 80 g/m$^2$, and a reflection loss and a transmission loss at 2.5 GHz of 0.03 dB and 74 dB, respectively, was used.

As the ground conductor (12), conductive cloth having square shape with a side length of 150 mm, a thickness of 0.15 mm, a surface density of 80 g/m$^2$, and a reflection loss and a transmission loss at 2.5 GHz of 0.03 dB and 74 dB, respectively, was used.

As the dielectric substrate (13), cheap square felt having a side length of 150 mm, a thickness of 1 mm, and a relative dielectric constant of 1.43 was used.

As a feeding connector, a nearly square shape SMA connector having a side length of grounding surface contacting with the ground conductor (12) of 12.5 mm, was used.

As the conductive medium (23), a copper foil tape (No. 1181 produced from Sumitomo 3M Ltd.) was used.

The following results were obtained: Return loss of this antenna was about −20 dB under non-bent state, and resonance frequency was 2.505 GHz, which was gradually decreased with bending.

Gain was 6.5 dB, which showed 4.1 dB even under bending in U character, which is a practically acceptable value.

Beam width was found to be widened with further bending of an antenna, from the radiation pattern. Lowering of the gain under bending is caused also by the broadening effect of the beam width, in addition to change in resonance frequency.

INDUSTRIAL APPLICABILITY

A microstrip antenna of the present invention, and clothes attached with the antenna have the following effects by having the composition as described above.

Namely, the microstrip antenna can be incorporated in cloth-like shape, which is light weight, flexible and does not generate wrinkles, using cheap material, and can easily be used by being stitched or embedded into clothes or a hat, and be produced by soldering handily during the production process. Therefore, clothes attached with this microstrip antenna can be provided, which can be utilized for a spacesuit or location detective device in combination with a chipped GPS receiver and a location information transmitter and the like.

The invention claimed is:

1. A microstrip antenna, comprising:

a substantially planar radiating conductor;

a substantially planar ground conductor having larger area than the radiating conductor;

a dielectric substrate being set between the radiating conductor and the ground conductor; and a feeding cable, one terminal of the feeding cable being connected to the radiating conductor, the other terminal being connected to the ground conductor, wherein the radiating conductor and the ground conductor are cloth-like substances having flexibility and conductivity, and also the dielectric substrate is a cloth-like substance having flexibility and insulation property; and wherein the connection of the terminal of the feeding cable to the radiating conductor or the ground conductor is attained by soldering through a metallic plate-like substance adhered with conductive adhesives at a surface opposing to the radiating conductor or the ground conductor.

2. The microstrip antenna according to claim 1, wherein the metallic plate-like substance is made of copper as a main component.

3. The microstrip antenna according to claim 1, wherein the radiating conductor or the ground conductor is a cloth which is woven or compressed by a polyester fiber which is coated with copper and covered with a surface nickel layer on the copper coating.

4. The microstrip antenna according to claim 1, wherein the radiating conductor or the ground conductor is a cloth which is woven or compressed by an aramid fiber which is coated with copper and covered with a surface nickel layer on the copper coating.

5. The microstrip antenna according to claim 1, wherein the dielectric substrate is made of felt.

6. The microstrip antenna according to claim 1, wherein the dielectric substrate is made of clothing fabric.

7. Clothes attached with a microstrip antenna, characterized that the microstrip antenna according to claim 1 is attached at the exterior surface of the clothes.

* * * * *